United States Patent [19]

Lüedemann et al.

[11] 4,332,339

[45] Jun. 1, 1982

[54] WEB-ADVANCING APPARATUS

[75] Inventors: Heinz Lüedemann; Klaus Schneider, both of Munich, Fed. Rep. of Germany

[73] Assignee: AGFA-Gevaert AG, Leverkusen, Fed. Rep. of Germany

[21] Appl. No.: 162,035

[22] Filed: Jun. 20, 1980

[30] Foreign Application Priority Data

Jul. 21, 1979 [DE] Fed. Rep. of Germany ..... 2929611

[51] Int. Cl.[3] ..... B65H 23/16; B65H 77/00

[52] U.S. Cl. ..... 226/195; 242/75.3; 242/147 R

[58] Field of Search ..... 226/195, 44, 45; 242/147 R, 128, 156, 156.2, 45, 75.3, 129.1, 129.2, 75.43, 75.5

[56] References Cited

U.S. PATENT DOCUMENTS

| | | | |
|---|---|---|---|
| 1,462,604 | 7/1923 | Lavalle | 242/156.2 X |
| 2,419,808 | 4/1947 | Wirth | 242/156.2 |
| 2,570,773 | 10/1951 | Davis | 242/75.3 X |
| 2,983,468 | 5/1961 | Perrella | 242/156.2 |
| 2,992,792 | 7/1961 | Van Der Hoek | 242/45 X |
| 3,366,147 | 1/1968 | Picanol | 242/75.3 X |
| 3,405,857 | 10/1968 | Albrecht | 242/75.3 X |

*Primary Examiner*—Stanley N. Gilreath

*Attorney, Agent, or Firm*—Michael J. Striker

[57] ABSTRACT

An apparatus for transporting webs of photographic material or the like has a web supply roll from which the web is pulled by a pull-off device. According to the invention a tilt arm is mounted intermediate the supply roll and the pull-off device and carries a roller at one end about which the web is drawn off, causing the arm to tilt. Tilting is resisted by a spring acting upon the other end of the arm. An arrangement is provided for varying the resisting force of the spring as a function of the tilted position of the arm.

6 Claims, 3 Drawing Figures

WEB-ADVANCING APPARATUS

BACKGROUND OF THE INVENTION

This invention relates to web-advancing apparatus.

In particular, the invention relates to apparatus for advancing strip-shaped photographic material, for example photographic paper supplied from a roll.

It is known to supply photographic paper in strips of e.g. 500 m or 600 m length which are wound on a supply roll. This paper is withdrawn from the supply roll by a pull-off device—e.g. a pair of nip rollers—and fed into a storage device from where it is advanced toward a processing station in stepwise manner. In general the withdrawal of the paper from the supply roll, and its forwarding to the storage device, is carried out intermittently rather than continuously. For this purpose the drive for the nip rollers is frequently energized and deenergized which each time results in a sudden tug at the supply roll. Since the inertia of the very heavy roll resists the tug initially, the paper is briefly subjected to high tension and may even tear; neither possibility is desirable, for evident reasons.

To counteract this problem it is known to interpose a tilt arm between the supply roll and the nip rollers; this arm has a guide roller about which the paper web is made to travel. A spring acts upon the arm, allowing it to yield to tensional stresses by tilting in the direction from which the tension is applied. This is intended to counteract sudden tensional stresses and to allow the heavy supply roll to start turning gradually in response to pull exerted by the nip rollers.

It has been found, however, that this prior-art equipment does not fulfill the expectations set by it. The reason is that the mass (and inertia) of a full (fresh) supply roll and an almost empty one, differ greatly from one another. As a consequence the shock damping effect of the tilt arm is ineffective during withdrawal of the final third of the paper length from the roll, if the spring force acting upon the tilt arm is too great. Conversely, if the spring force is too small, then the tilt arm will not dampen any shock forces during the withdrawal of an initial length of paper from the roll.

SUMMARY OF THE INVENTION

Accordingly, it is an object of the invention to overcome the disadvantages of the prior art.

A more particular object is to provide a web-advancing apparatus of the type in question (which is of course not limited to use with photographic materials), wherein proper withdrawal of the web from the supply roll is assured, irrespective of the amount of web remaining on the supply roll at any given instant.

A concomitant object is to provide an apparatus as just outlined, which is simple in construction and reliable in operation.

In pursuance of these objects and of still others which will became apparent hereafter, one aspect of the invention resides in an apparatus for advancing webs, particularly webs of photographic material, from a supply roll to a pull-off device. Briefly stated, such an apparatus may comprise a member turnable about an axis intermediate the supply roll and the pull-off device to any of a plurality of angularly displaced positions; guide means on the member for guiding the web towards the pull-off device, the pull exerted by the pull-off device causing the member to become angularly displaced about the axis; first means for resiliently resisting such angular displacement; and second means for varying the resisting force exerted by the first means as a function of the angular position assumed by the member.

An apparatus according to the invention assures that the spring force counteracting the tug created by the nip rollers, is varied to accommodate it to the requirements of a particular instant. In other words: if the mass of the supply roll is high, the tilt action of the tilt arm is relatively hard; it becomes increasingly softer as the mass of the supply roll decreases, i.e. as less and less length of web remains on the supply roll. For example, to withdraw paper web from a paper-web supply roll having 500 m of the web wound onto it, a pulling force of about 100 N (Newton) is required. However, when enough web has subsequently been pulled off so that only a fraction of the original 500 m remains on the roll, say about 100 m, the pulling force required to make the roll turn is only about 30 N. It is to be noted, however, that the force acting at the tilt arm is not proportional to the roll diameter (which is a measure of roll mass since it decreases as the mass decreases), because the force acting at the tilt arm also varies in dependence upon the pull-off direction which in turn varies as the roll diameter decreases.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
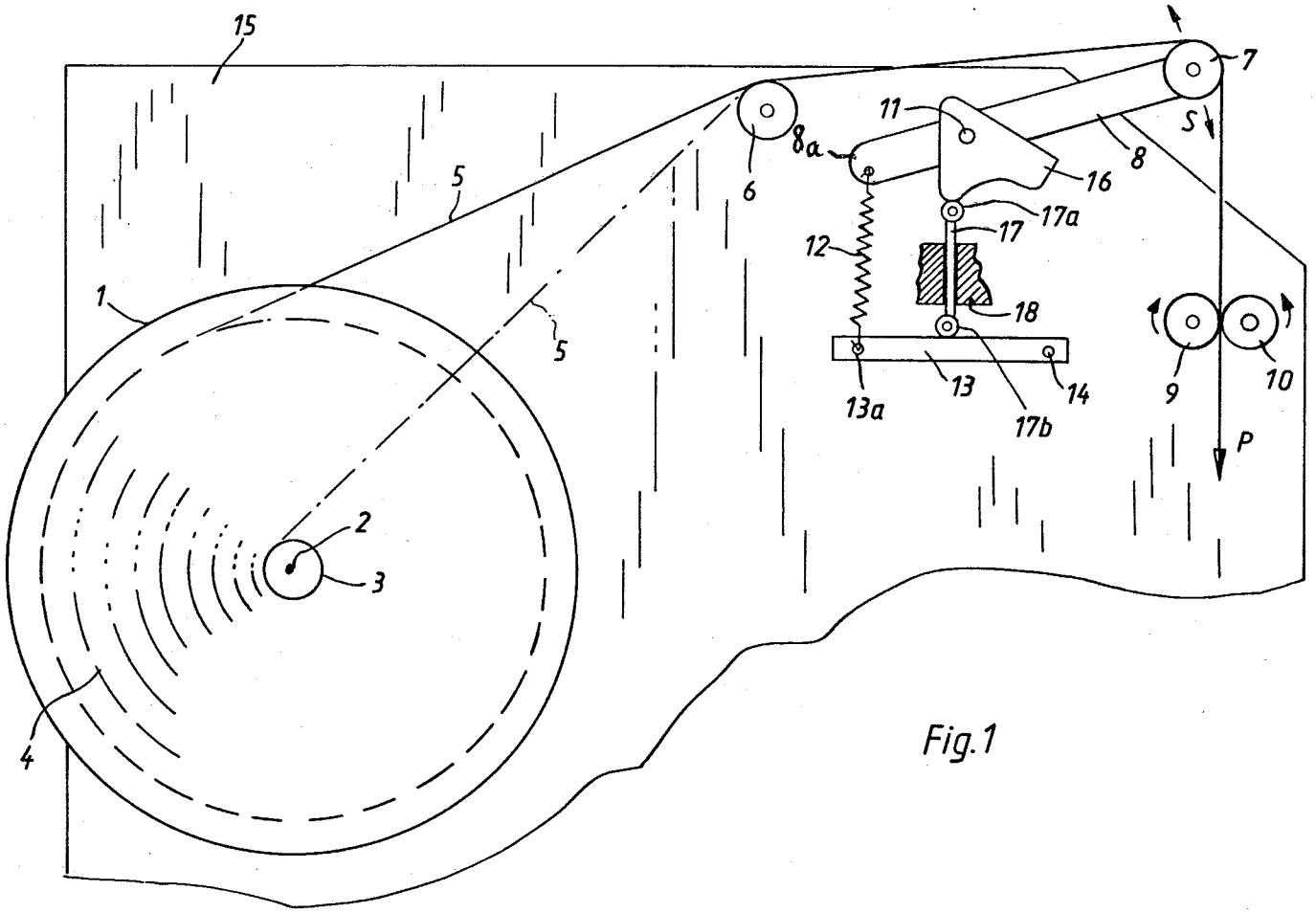
FIG. 1 is a diagrammatic side view of a first embodiment of the invention.

A first embodiment of the invention is illustrated in FIG. 1 where reference numeral 1 identifies a web supply roll 1 having a core or mandrel 3 which is mounted for rotation about an axis 2. A web 5—of e.g. photographic paper or, for that matter, of any other strip-shaped material—is wound onto the core 3 to form a winding 4 thereon. Web 5 is guided over an idler roller 6 and to a pull-off device, here illustrated in form of a pair of nip rollers 9, 10 at least one of which is driven. The angle relative to roller 6 at which web 5 is pulled off the roll 1 varies, depending upon whether the roll is full (solid line 5) or almost empty (broken line 5), or of course any point between these two extremes.

To dampen the tug or shock transmitted to the web 5 and roll 1 when the drive for the nip rollers 9, 10 is suddenly energized, a tilt arm 8 is interposed between the roll and the nip rollers. This arm is tiltable about an axis 11 intermediate its end portions. The end portion close to the nip rollers 9, 10 carries a web guide roller 7 about which the web 5 travels to the nip rollers; the other end portion 8*a* has one end of a contraction spring 12 connected to it. A control arm 13 is pivotable at one end portion about an axis 14; its other end portion 13*a* has the second end of the spring 12 connected to it.

All of the aforementioned axes and the axes of all rotary components involved, extend parallel to one another. All the components—with the exception of roll 7—may be mounted on a common support 15, for example a supporting plate as fragmentarily illustrated. Roll 7 is so heavy as to require its own support (not shown) to which the support 15 could be secured, if desired.

A cam plate 16 is turnable about the axis 11 together with the arm 8; i.e. it shares the movements of the latter. A plunger 17 is slidably guided in a stationary guide 18 and carries contact rollers 17*a*, 17*b* at its opposite ends. Roller 17*a* tracks the cam surface of cam plate 16, whereas roller 17*b* engages the control arm 13 about midway between the ends thereof.

When the apparatus of FIG. 1 is in its illustrated rest position, i.e. when the nip rollers 9, 10 do not exert a pull upon the web 5 in the direction P, the cam plate 16 maintains the end portion 13*a* of arm 13 at a predetermined distance from the end portion 8*a* of arm 8 (via plunger 17), thereby stressing the spring 12 to the desired extent. When the nip rollers are driven and exert a pull on web 5 in the direction P, the arm 8 is pivoted about axis 11 in the direction S (clockwise) and the roll slowly begins to turn, the initial shock of the tug exerted by the nip rollers having been absorbed by the pivoting of the arm 8. The cam plate 16 of course tilts with the arms 8; the consequences of this tilting will be described with reference to the embodiment in FIG. 2, since despite the differences in the two embodiments the function of the cam plate 16 is the same in both cases.

Figure 2:
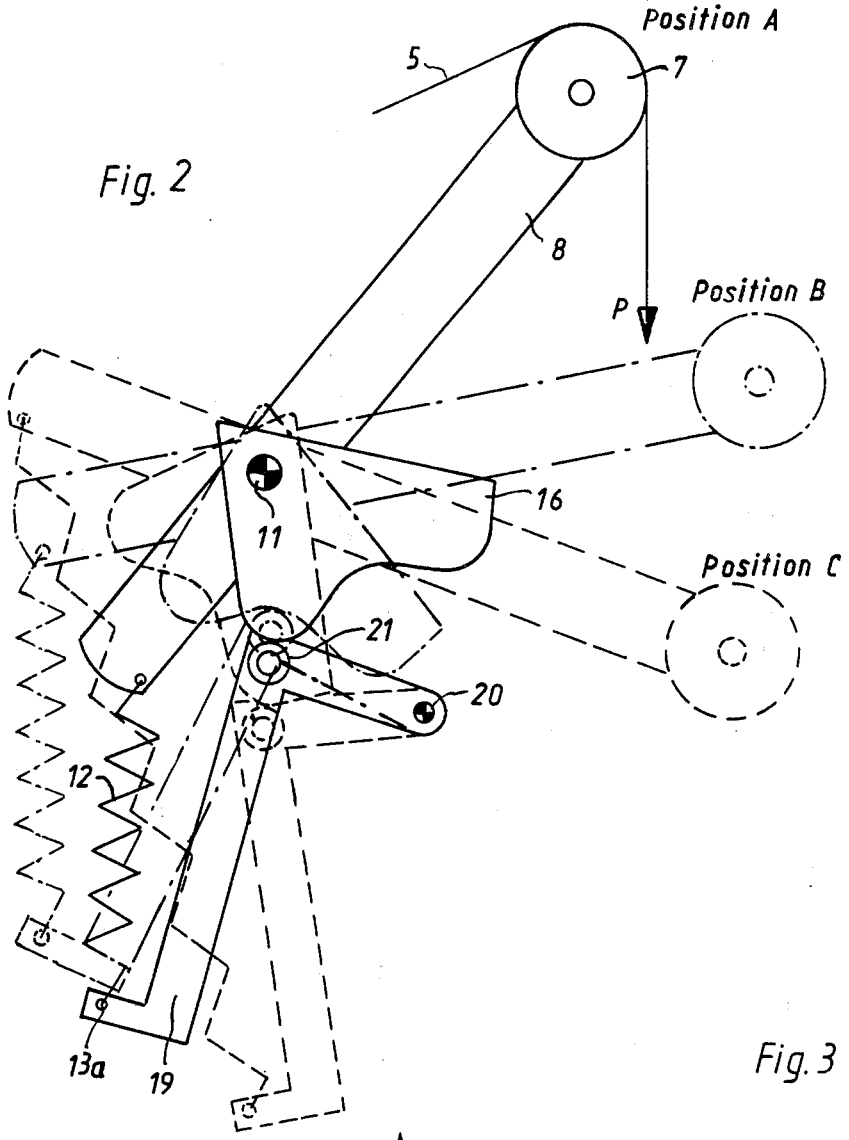
FIG. 2 is a diagrammatic side view of a second embodiment of the invention, with some parts omitted.

Referring now to FIG. 2, it will be seen that only the tilt arm and associated elements have been shown there; the arrangement of the not-illustrated elements is the same as in FIG. 1. Like elements are designated with the same reference numerals as in FIG. 1.

In FIG. 2 the straight control arm 13 is replaced by an angled control arm 19 which at one end is pivotable about an axis 20. At the other end of arm 19 the spring 12 is secured at 13*a*, as in FIG. 1. Cam plate 16 turns with arm 8 as before, but the plunger 17 and guide 18 are omitted. Instead, the cam plate 16 cooperates directly with a roller 21 which is mounted on the arm 19 in the illustrated position and tracks the cam face of plate 16.

Figure 3:
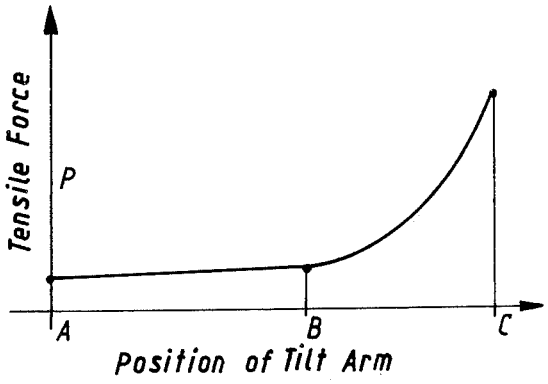
FIG. 3 is a force diagram applicable to the invention.

The function of cam plate 16 is evident from FIG. 2 which should be considered in conjunction with FIG. 3.

FIG. 2 shows three different positions A, B and C (of the arms 8 and 9), and hence three different spring forces. In the full-line position A the spring 12 is stressed (i.e. stretched) to the smallest extent (cf. FIG. 3). In the dot-dash position B the spring 12 is stressed slightly more, i.e. it opposes the pull exerted by the nip rollers with slightly increased resistance. In the dashed-line position C, however, the resistance of the spring 12 has increased to a multiple of the resistance offered in position A (the spring having been further expanded). As FIG. 3 shows, the increase of the spring resistance from position A to position B is small and linear, whereas from position B to position C the increase is strongly exponential.

If, in either of FIGS. 1 and 2, the force P which depends upon the diameter of the winding 4 on roll 1 is very large, then the arm 8 will tilt to (or approach) the position C, in which the resistance of spring 12 is also great; this makes it easier for the arm 8 later to return to its position A. If the force P is smaller, the arm 8 is moved only to position B and requires only a smaller spring force (corresponding to the position B) to return to position A. It is understood, of course, that the illustrated position A, B and C have been arbitrarily chosen for purposes of explanation. The actual behavior of the varying spring force is of course essentially dependent upon the tensile force in direction P. The shape of the cam plate 16 takes account of the non-linear force requirement at the spring, as well as of the shape of the angled lever 19 of FIG. 2.

While the invention has been illustrated and described as embodied in an apparatus for advancing strips of photographic material, such as photographic paper, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an apparatus for advancing webs, particularly webs of photographic material, from a supply roll to a pull-off device, a combination comprising a member turnable about an axis intermediate the supply roll and the pull-off device to any of a plurality of angularly displaced positions, said member being formed as a tilt arm having first and second end portions; guide means on said member for guiding the web towards the pull-off device and including a roller turnably mounted on said first end portion of said tilt arm, the pull exerted by the pull-off device causing said member to become angularly displaced about said axis; first means for resiliently resisting such angular displacement and including a biasing spring; and second means for varying the resisting force exerted by said first means as a function of the angular position assumed by said member, said second means including a motion-transmitting element movable in response to angular displacement of said arm and varying said resisting force as a function of its movement to respective different positions, and a pivotable control arm, said spring being connected between said control arm and said second end portion of said tilt arm, said motion-transmitting element acting upon and determining the position of said pivotable control arm relative to said second end portion.

2. A combination as defined in claim 1, said motion-transmitting element comprising a cam.

3. A combination as defined in claim 2, said cam being turnable with said tilt arm about said axis thereof.

4. A combination as defined in claim 1, said second means further comprising a roll mounted on said control arm and engaged by said motion-transmitting element which transmits motion to said control arm via said roll.

5. A combination as defined in claim 1 said second means further comprising a plunger having spaced portions engaged with and slidable relative to said motion-transmitting element and said control arm, respectively, for transmitting motion therebetween.

6. A combination as defined in claim 1, said member being turnable from a starting position towards an end position through a first and a subsequent second displacement range, and said spring of said first means being arranged to resist such turning with a force which increases linearly and only slightly during turning of said member from said starting position through said first range, but increases strongly exponentially during turning of said member through said second range towards said end position.

* * * * *